United States Patent [19]

Hurt

[11] 4,374,599

[45] Feb. 22, 1983

[54] SECURITY LOCK FOR DOOR

[76] Inventor: Alfred A. Hurt, 116 Harvey Ave., Oak Hill, W. Va. 25901

[21] Appl. No.: 206,474

[22] Filed: Nov. 13, 1980

[51] Int. Cl.[3] ..... E05C 3/04; E05C 17/18

[52] U.S. Cl. ..... 292/270

[58] Field of Search ..... 292/268, 269, 270, 273, 292/274, 296, 305

[56] References Cited

U.S. PATENT DOCUMENTS 351,147 10/1886 Adams ..... 292/270

3,265,425 8/1966 Berger ..... 292/202

FOREIGN PATENT DOCUMENTS 443606 3/1936 United Kingdom ..... 292/270

*Primary Examiner*—Richard E. Moore

*Attorney, Agent, or Firm*—Harvey B. Jacobson

[57] ABSTRACT

A first stationary flange is supported from the free swinging edge of a door and projects outwardly of the opening side of the door. A second pivoted flange is mounted from the doorjamb opposing the stationary flange and is swingable, about an axis generally paralleling the axis of pivotal movement of the door, between an operative position paralleling and closely opposing the stationary flange and a retracted position disposed normal to and projecting away from the stationary flange. The stationary flange includes a stop pin projecting toward the second flange and the latter includes openings spaced therealong in which the pin may be selectively engaged to lock the door against swinging movement. The pin is retractable away from the pivoted flange and the latter is mounted for limited shifting along its pivot axis. The pivoted flange is free to swing between its operative and retracted positions when in a first limit position and locked against swinging from the operative position toward the retracted position when in the second limit position. The stationary flange additionally includes laterally projecting guide slidingly received in a longitudinal slot in the stationary flange. Engagement of the guide within the slot of the pivoted flange prevents movement of the pivoted flange from the second limit position to the first limit position.

8 Claims, 7 Drawing Figures

Fig. 5
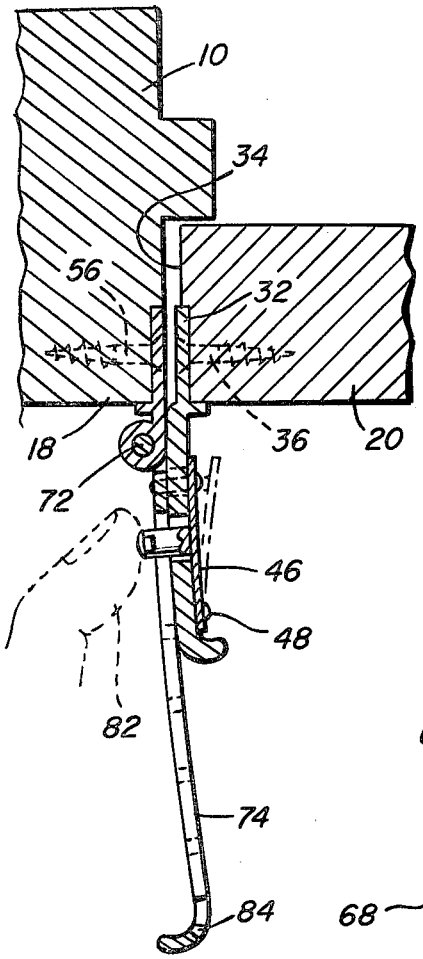
Fig. 6
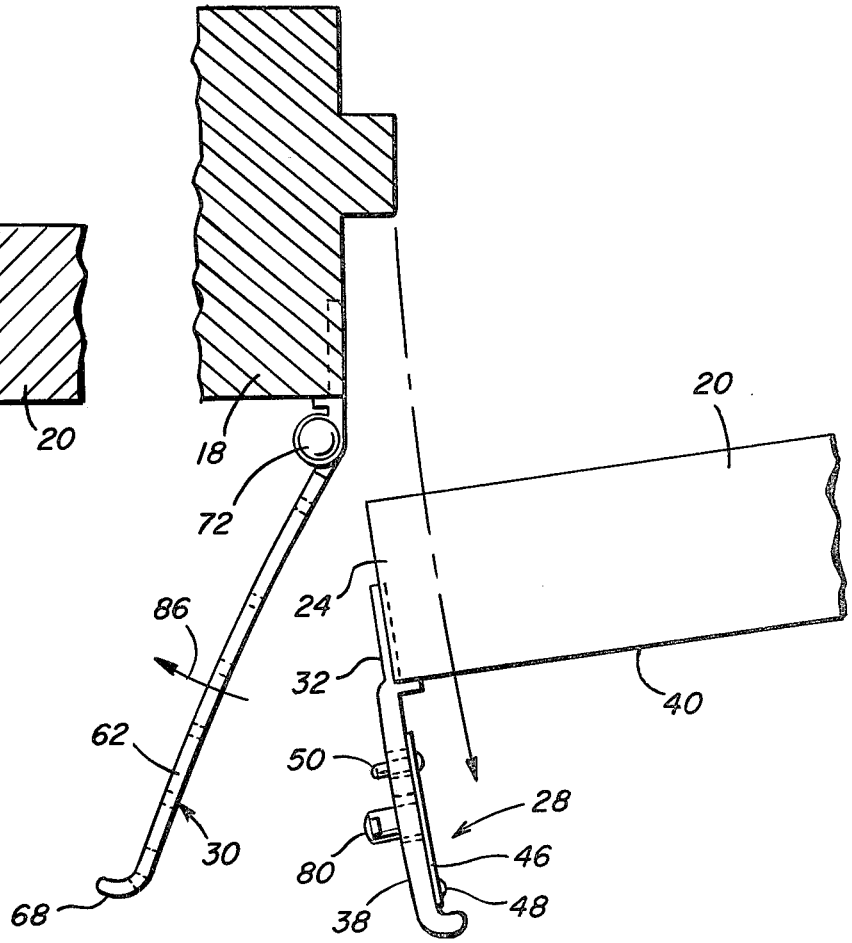
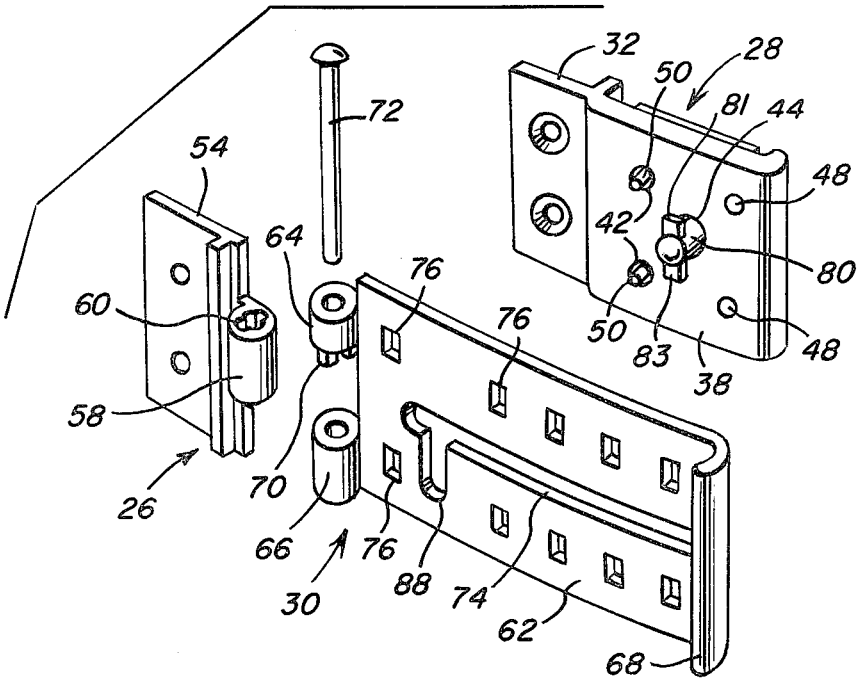
Fig. 7

SECURITY LOCK FOR DOOR

BACKGROUND OF THE INVENTION

Various forms of door security lock structures heretofore have been provided. Some of these security lock structures include features thereof which enable a door to be partially opened, but locked against unrestricted further opening to thus enable a person on the inside of a door to view the area outside of the door. However, many of these security locks utilize chains for accomplishing the locking function of the door in a partially opened position and chains allow an intruder to initially pull the door toward a closed position and then to forcibly move the door toward an open position with momentum of the intruder and the door being sufficient, in most cases, to break the door restraining chain. Accordingly, a need exists for an improved form of security lock for doors which will enable doors to be securely locked in a partially opened position not only against further movement toward the open position but also against movement toward the closed position.

Examples of various forms of door security locks including some of the general structural and operational features of the instant invention are disclosed in U.S. Pat. Nos. 267,035, 771,588, 2,461,398, 2,562,916 and 3,411,817.

BRIEF DESCRIPTION OF THE INVENTION

The security lock of the instant invention is constructed in a manner whereby an associated door may be locked in various partially opened positions against movement in either direction. The security lock includes structural features which enable the lock to be utilized in conjunction with substantially any form of swinging door and the lock is of such structure to enable ready operation thereof, even by inexperienced persons.

The main object of this invention is to provide a door security lock which will be capable of releasably locking a door in various partially opened positions.

Another object of this invention is to provide a security lock in accordance with the preceding object and including structure whereby the associated door will be locked in the adjusted position thereof not only against further opening but also against further closing.

Still another important object of this invention is to provide a security lock which may be readily utilized in conjunction with substantially any form of swinging door.

A further object of this invention is to provide a security lock which may be readily operated by even inexperienced persons.

Still another important object of this invention is to provide a security lock specifically adapted for secure mounting on related door and jamb components.

A final object of this invention to be specifically enumerated herein is to provide a door security lock in accordance with the preceding objects and which will conform to conventional forms of manufacture, be of simple construction and easy to use as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 5 is a horizontal sectional view taken substantially upon the plane indicated by the section line 5—5 of FIG. 1 and on somewhat of an enlarged scale;

FIG. 6 is a top plan view of the lock assembly with the pivoted flange thereof partially swung toward a retracted position and the door being swung toward an open position; and FIG. 7 is an exploded perspective view of the security lock.

DETAILED DESCRIPTION OF THE INVENTION

Figure 1:
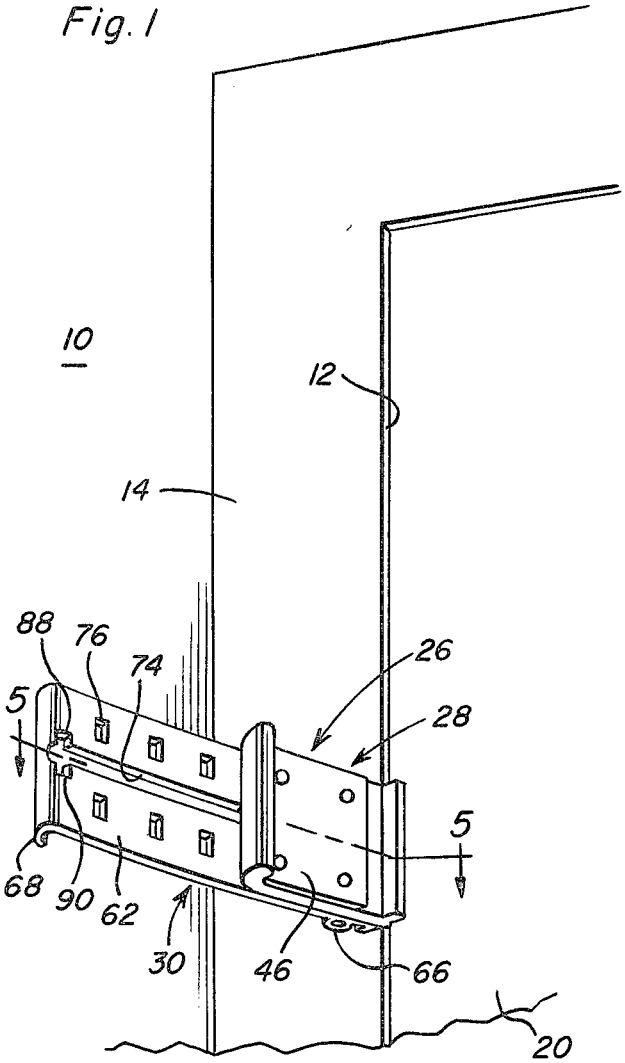
FIG. 1 is a fragmentary perspective view of a door and jamb assembly with which the lock assembly of the instant invention is operatively associated.
Figure 2:
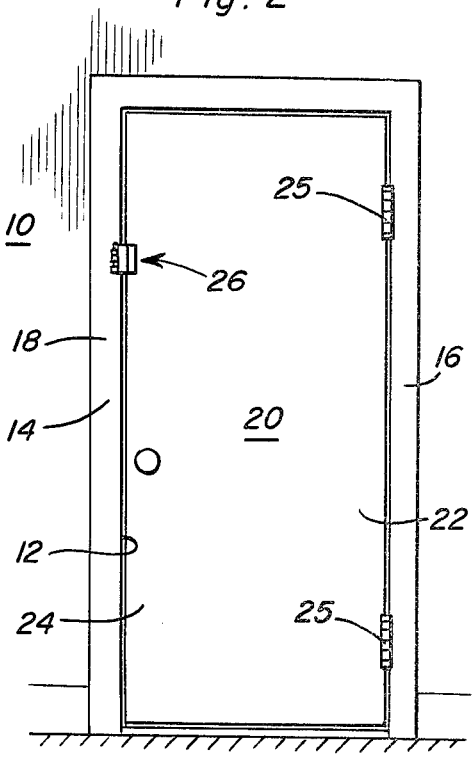
FIG. 2 is an elevational view of the assemblage illustrated in FIG. 1 on somewhat of a reduced scale.

Referring now more specifically to the drawings the numeral 10 designates a wall structure having a door opening 12 defined therethrough by a door frame 14 including first and second marginal portions 16 and 18. A door 20 is provided and includes first and second marginal portions 22 and 24 with the marginal portion 22 hingedly supported from the marginal portion 16 through the utilization of door hinges 25.

The security lock of the instant invention is referred to in general by the reference numeral 26 and includes first and second components 28 and 30. The first component 28 includes a base flange 32 secured to the edge 34 of the door 20 opposing the second marginal portion 18 through the utilization of fasteners 36 and an extension flange 38 formed integrally with the base flange 32 and which projects outwardly of the side 40 of the door 20 which faces in the direction in which the door 20 opens. The extension flange 38 is provided with a pair of vertically spaced apertures 42 therein and a third larger aperture 44. A spring plate 46 is secured by rivets 48 to the outer end of the extension flange 38 on the side thereof remote from the second component 30 and extends toward the door 20. The end of the plate 46 remote from the fasteners or rivets 48 and adjacent the door 28 includes a pair of laterally projecting pins 50 which extend outwardly therefrom, through and beyond the apertures 42.

The second component 30 includes a base flange 54 secured to the marginal portion 18 through the utilization of fasteners 56 and projecting slightly outwardly of the side of the marginal portion 18 toward which the door 20 swings when being opened. The outwardly projecting portion of the base flange 54 defines a single hinge barrel 58 including a diametric kerf 60 in its upper end.

The second component 30 additionally includes an extension flange 62 including a pair of vertically spaced hinge barrels 64 and 66 on one end between which the barrel 58 is receivable and a laterally outwardly turned portion 68 on its free end. The upper hinge barrel 64 of the extension flange 62 includes diametrically opposite lugs 70 downwardly receivable within the kerf 60 and upwardly retractable therefrom, a pivot pin 72 being passed through the barrels 64, 66 and 60 to pivotally support the extension flange 62 from the base flange 54.

The extension flange 62 includes a longitudinal central slot 74 and longitudinally spaced pairs of upper and lower openings 76 formed therethrough above and below the slot 74 in which the outer ends of the pins 50 are selectively receivable.

In operation, when the door 20 is in the closed position thereof illustrated in FIG. 5 of the drawings and the lugs 70 are downwardly received in the kerf 60, the extension flange 62 is locked in the position thereof illustrated in FIG. 5 of the drawings against pivotal movement relative to the base flange 54. Further, when the spring plate 46 is in the solid line position illustrated in FIG. 5, the pins 50 project through the apertures 52 and into the openings 76 closely adjacent the barrels 64 and 66 and thus lock the door 20 in the closed position thereof illustrated in FIG. 5.

When it is desired to swing the door toward a partially opened position, a button 80 supported from the spring plate 46 intermediate the pins 50 and the rivets 48 and projecting through the aperture 44 is pushed as indicated at 82 in FIG. 5 to cause flexure of the spring plate 46 and retraction of the pins 50 from the openings 76. Thereafter, the door 20 may be swung further toward an open position and locked in adjusted partially opened position by reception of the pins 50 through openings 76 spaced closer to the free end of the extension flange 62 upon release of finger pressure on the button 80. Additionally, when it is desired to open the door 20 to a fully opened position, the button 80 is depressed and the door 20 is swung toward the full open position with the free end of the button 80 received through the outer end 84 of the slot 74. After the extension flange 38 of the first component 28 has been disengaged from the extension flange 62 of the second component 30, the extension flange 62 may be upwardly displaced relative to the base flange 54 in order to withdraw the lugs 70 from the kerf 60, thereby allowing the extension flange 62 to be swung in a clockwise direction in the manner illustrated by the arrow 86 in FIG. 6 of the drawings. In this manner, the extension flange 62 may be swung to a fully retracted position closely paralleling the wall 10. Also, the extension flange 62 includes an upwardly opening notch 88 formed therein opening upwardly into the lower marginal portion of slot 74. The notch 88 allows the button 80 to be depressed to retract the pins 50 and the flange 62 thereafter to be elevated to withdraw the lugs 70 from the kerf 60 and thereby allow the flange 62 to be swung in the direction of arrow 86 in FIG. 6 without first displacing the button 80 through the outer end of slot 74. Still further, the arcuate flange 62 has a radius of curvature substantially equal to the spacing of the flange 62 from the axis (not shown) of oscillation of the door 20.

Figure 3:
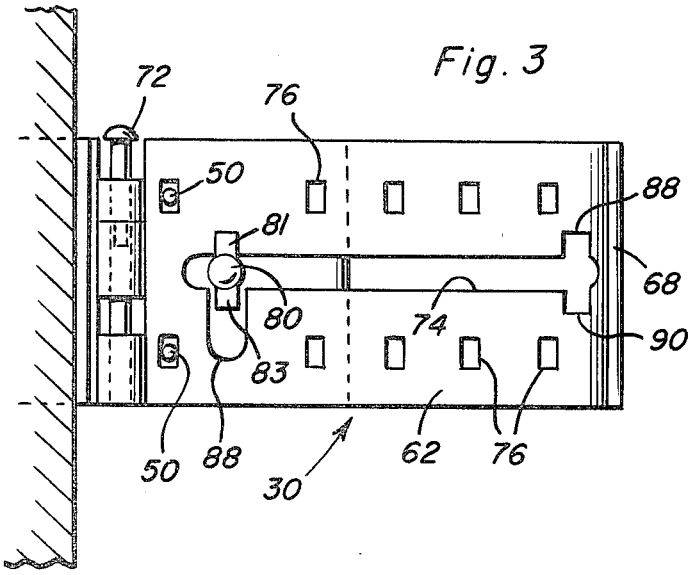
FIG. 3 is a side elevational view of the lock as seen from the left side of FIG. 1 and with the various components of the lock in a locked condition.
Figure 4:
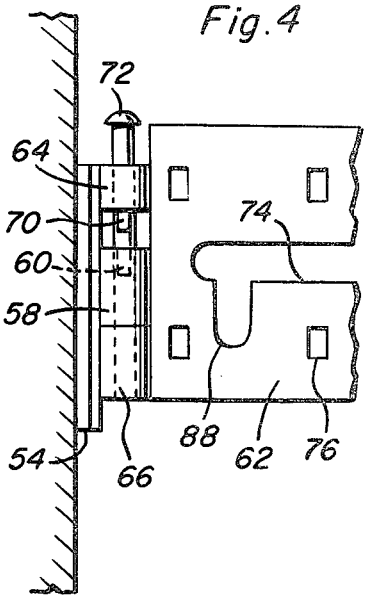
FIG. 4 is a fragmentary side elevational view similar to FIG. 3 but illustrating the pivoted flange portion of the lock in an upwardly displaced position enabling its swinging from an operative position toward a retracted position.

Finally, the extended end of button 80 includes upwardly and downwardly projecting lugs 81 and 83 which, when the flange 62 and plate 46 are relatively positioned similar to those positions illustrated in FIG. 3 but with the door slightly open, prevent sufficient forced flexure between the flanges 38 and 62 to effect withdrawal of the pins 50 from the apertures 42 independent of flexure of the spring plate 46 relative to the flange 38. However, the outer end of the slot 74 includes enlargements 88 and 90 for receiving the lugs 81 and 83 therethrough.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a structural member defining a door opening therethrough between first and second opposing marginal portions of said structural member and including a door having a first edge portion hingedly supported from said first marginal portion for swinging movement of a second opposite door edge portion toward and away from said second marginal portion, a releasable security lock including first and second components each including a base flange mounted on a corresponding second portion, said base flanges including extension flanges closely paralleling each other and said second portions and projecting outwardly from said second portions in the direction in which said door swings toward the open positions, one of said extension flanges defining a latching element receiving recess therein and the other of said extension flanges including a latching element projecting outwardly therefrom into said recess and shiftable relative to said other extension flange from an operative position to a retracted position withdrawn from said recess, pivot means pivotally supporting said one extension flange from the corresponding base flange for oscillation relative thereto about an axis generally paralleling the axis of oscillation of said door, said one extension flange and the corresponding base flange including co-acting latch means operative to releasably secure said one extension flange in operative position generally paralleling the other extension flange, said pivot means including means operative to allow shifting of said one extension flange relative to the corresponding base flange along the axis of oscilation of said one extension flange relative to the corresponding base flange between first and second positions, said latch means being inoperative, when said one extension flange is in said second position and operative when said one extension flange is in said first position.

2. The combination of claim 1 wherein said extension flanges include co-acting shift preventing means operative, when said door is in said closed position and said one extension flange is in said first position, to prevent shifting of said one extension flange from said first position toward said second position, said shift preventing means being inoperative to prevent shifting of said one extension flange to said second position responsive to said door being swung from said closed position past a predetermined partially opened position.

3. The combination of claim 1 wherein said one extension flange and the corresponding base flange are supported from said second marginal portions.

4. The combination of claim 1 including means yieldingly biasing said latching element toward said operative position.

5. The combination of claim 1 wherein said one extension flange includes a plurality of said recesses spaced therealong with which said latching element may be engaged to latch said door in varied partially open positions.

6. In combination with a structural member defining a door opening therethrough between first and second opposing marginal portions of said structural member and including a door having a first edge portion hingedly supported from said first marginal portion for swinging movement of a second opposite door edge portion toward and away from said second marginal portion, a releasable security lock including first and second components each including a base flange mounted on a corresponding second portion, said base flanges including extension flanges closely paralleling each other and said second portions and projecting outwardly from said second portions in the direction in which said door swings toward the open position, one of said extension flanges defining a latching element receiving recess therein and the other of said extension flanges including a latching element projecting outwardly therefrom into said recess and shiftable relative to said other extension flange from an operative position to a retracted position withdrawn from said recess, said one extension flange including a plurality of said recesses spaced therealong with which said latching element may be engaged to latch said door in varied partially open positions, said recesses defining openings formed through said one extension flange and said latching element comprises an elongated pin lengthwise retractable laterally of said other extension flange.

7. In combination with a structural member defining a door opening therethrough between first and second opposing marginal portions of said structural member and including a door having a first edge portion hingedly supported from said first marginal portion for swinging movement of a second opposite door edge portion toward and away from said second marginal portion, a releasable security lock including first and second components supported from said second marginal and edge portions, said first and second components including base and extension flanges, said base flanges being anchored relative to said second edge and marginal portions, the extension flange carried by said second edge portion comprising an elongated flange formed integrally with the corresponding base flange, having laterally outwardly projecting pin means retractably supported therefrom and projecting outwardly from the side of said door toward which the latter is swung toward the open position, the extension flange of the base flange supported from said second marginal portion being pivotally supported therefrom for angular displacement about an axis generally paralleling the axis of rotation of the door, the last mentioned extension flange having openings formed therethrough at points spaced longitudinally therealong at different distances from said axis and in which said pin means is receivable, the last mentioned extension flange being shiftable axially of its pivot axis relative to the corresponding base flange, the pivoted extension flange and the corresponding base flange including means releasably locking the extension flange against pivotal movement relative to the corresponding base flange.

8. In combination with a structural member defining a door opening therethrough between first and second opposing marginal portions of said structural member and including a door having a first edge portion hingedly supported from said first marginal portion for swinging movement of a second opposite door edge portion toward and away from said second marginal portion, a releasable security lock including first and second components each including a base flange mounted on a corresponding second portion, said base flanges including extension flanges closely paralleling each other and said second portions and projecting outwardly from said second portions in the direction in which said door swings toward the open position, one of said extension flanges defining a latching element receiving recess therein opening laterally outwardly of said one extension flange toward the other extension flange, the other of said extension flanges including a latching element projecting laterally outwardly therefrom toward said one extension flange and being removably received in said recess and shiftable relative to said other extension flange from an operative outwardly projecting position to a retracted position withdrawn from said recess, pivot means pivotally supporting said one extension flange from the corresponding base flange for oscillation relative thereto about an axis generally paralleling the axis of oscillation of said door, said one extension flange and the corresponding base flange including coacting latch means operative to releasably secure said one extension flange in operative position generally paralleling the other extension flange, said one extension flange, when said latch means is released, being swingable away from said other extension flange.

* * * * *